US008641224B1

(12) United States Patent
de Blois

(10) Patent No.: US 8,641,224 B1
(45) Date of Patent: Feb. 4, 2014

(54) LOW PROFILE TABLE LAMP

(75) Inventor: Martin de Blois, Gallatin, TN (US)

(73) Assignee: Agio International Company, Ltd., Hong Kong (HK)

( * ) Notice: Subject to any disclaimer, the term of this patent is extended or adjusted under 35 U.S.C. 154(b) by 263 days.

(21) Appl. No.: 13/346,214

(22) Filed: Jan. 9, 2012

Related U.S. Application Data

(60) Provisional application No. 61/430,699, filed on Jan. 7, 2011.

(51) Int. Cl.
*F21V 33/00* (2006.01)

(52) U.S. Cl.
USPC ..... 362/184; 362/234; 362/253; 362/364; 362/127

(58) Field of Classification Search
USPC ..... 362/184, 234, 253, 364, 374, 375, 395, 362/410, 33, 12, 132, 133, 134
See application file for complete search history.

(56) References Cited

U.S. PATENT DOCUMENTS

| | | | | |
|---|---|---|---|---|
| 4,161,767 | A * | 7/1979 | Benasutti et al. | 362/33 |
| 5,205,632 | A * | 4/1993 | Crinion | 362/33 |
| 5,876,262 | A * | 3/1999 | Kelly et al. | 446/118 |
| 5,921,655 | A * | 7/1999 | Nassim | 362/147 |
| 7,234,702 | B2 * | 6/2007 | Lipscomb et al. | 273/309 |
| 7,661,836 | B1 * | 2/2010 | Naranjo | 362/102 |
| 8,061,864 | B2 * | 11/2011 | Metcalf et al. | 362/127 |
| 8,262,244 | B2 * | 9/2012 | Metcalf et al. | 362/127 |
| 8,469,539 | B2 * | 6/2013 | Stobart | 362/157 |
| 2007/0047224 | A1 * | 3/2007 | Lee | 362/132 |

* cited by examiner

*Primary Examiner* — Bao Q Truong

(74) *Attorney, Agent, or Firm* — Williams Mullen

(57) ABSTRACT

A low profile table lamp having a replaceable power supply and circuitry to power at least one light is provided. A bottom housing has a central cylinder with threads internally and an exterior mounting surface for a ring of lights. The bottom housing contains the battery, circuitry, light element and a switch. Included is a top cover having a post with threads externally to mate with the central cylinder inclined ridges and a top crown. Attached to the top cover is a light diffusion dish having a central orifice with a diameter greater than the outside diameter of the central cylinder for receiving the post. The crown has a surface of a greater size than the light diffusion dish covering the central orifice. The post is removably joined from above to the central cylinder for accessing the battery.

18 Claims, 13 Drawing Sheets

LOW PROFILE TABLE LAMP

CROSS-REFERENCE TO RELATED APPLICATION

The present application claims the benefit of U.S. Provisional Application No. 61/430,699, filed Jan. 7, 2011, the entire contents of which are incorporated herein by reference.

BACKGROUND OF THE INVENTION

1. Field of the Invention

The present invention relates generally to the field of self contained lamps and, in particular, decorative lamps that may be used for outdoor dining in conjunction with other furniture, such as patio tables and umbrella tables.

2. Description of the Related Art

Self contained lamps for use on patio tables with central openings for umbrellas are generally placed off center. These lighting devices are often movable, situated on a tabletop, and can interfere with the diner's placement of food or utensils.

Centralized light emitting diode (LED) lighting has been developed that is secured through the central opening in the table top via a threaded ring, and provides the LED lighting below the table top surface. This lighting requires that the table top be transparent or translucent or of an open mesh in order to be visible to the person dining and is perceived as little dots of intense light. There is little diffusion, and illumination is poor.

In addition, the replacement of the battery requires the user to open the lamp from under the table top. This is very unsuitable for dining table or coffee table heights.

SUMMARY OF THE INVENTION

Disclosed are embodiments of a low profile lamp for use in a table having a table top.

In one embodiment, the table top has a top surface, wherein the table top defines a cavity in the surface with a first effective diameter and a first effective depth. The lamp has a housing with a bottom and an outer wall, the outer wall and bottom wall define a compartment with a top opening. A fastening device may be used for fastening the housing to the table top when the housing is placed within the cavity. This compartment may have a second effective depth that is less that is less than the first effective depth. The outer wall has an outer surface with a second effective diameter that is less than the first effective diameter. In this way, substantially all of the housing may be placed within the cavity. The housing also has an inner vertical surface that defines a first set of threads.

The low profile lamp includes at least one electric light source, an electric power supply, and wiring or circuitry in electrical communication with the electric power supply and the at least one light source to power the light source. The circuitry may also have a switch used for controlling the light source. The electric light source, the electric power supply, the circuitry, and the switch are generally positioned within the compartment of the housing.

The lamp may include a top cover having a crown and a post extending downwardly from the crown. This post may define a second set of threads that are adapted to mate with the first set of threads. The lamp may include a light diffusion dish that is horizontally disposed, and has a third effective diameter less than or equal to the first effective diameter. The light diffusion dish defines a central orifice for receiving the post, while exposing a cross sectional transmissive surface of the light diffusion dish to the central orifice. The light diffusion dish is adapted to be engaged with the top cover and positioned over the housing, while it is fastened to the table top within the cavity, so that the central orifice receives the post. The top cover of the lamp and the light diffusion dish may be rotated relative to the housing in a desired direction; with this rotation the post may be rotatably joined to the housing via the mating of the first and second sets of threads, removably sealing the compartment with the light diffusion dish and the top cover. This rotation of the top cover and the light diffusion dish increases the degree of mating of the first and second sets of threads. The light source is configured such that increasing the degree of mating of the first and second sets of threads increases exposure of the cross sectional transmissive surface to the light source, increasing light transmitted into the light diffusion dish. A desired degree of mating of the first and second sets of threads positions at least a portion of the light diffusion dish and the top cover substantially coplanar with the top surface of the table top.

In another embodiment, a low profile rotational table lamp for a table top may have at least one housing with a bottom and an outer wall. The outer wall and bottom define a compartment with a top opening, the housing further having an inner surface that includes or defines a first set of threads. Also included in the lamp is at least one electric light source. To support or power the light source is an electric power supply and sufficient wiring or circuitry in electrical communication with the electric power supply and at least one light source. The circuitry may include a switch for controlling the light source. The electric light source, electric power supply, circuitry, and switch are all positioned inside the compartment of the housing. The top cover includes a crown and a post that extends downwardly from the crown. The post has a second set of threads adapted to mate with the first set of threads. A horizontally disposed light diffusion dish is included, the dish having a central orifice for receiving the post, while revealing a cross sectional transmissive surface of the light diffusion dish to the central orifice. The lamp has a ring assembly that consists of an outer ring and an inner ring that is rotatably engaged with, and in direct contact with, the outer ring. The outer ring may include a pad for supporting the outer ring on a table top. The inner ring has a mounting foot to support and adhesively attaching it to the light diffusion dish at a desired height, so that it leaves or provides a gap above the inner ring. The lever is attached to the bottom housing and extends radially so as to stick out between the top surface of the inner ring and the bottom surface of the light diffusion dish. The lever may have a hinge (i.e., hinged along a vertical axis) that is positioned at a desired point on the lever, within the inner radius of the inner ring, so as to enable the lever to articulate about the vertical axis. The lever and hinge may be configured so that when the lever is articulated (or folded) the lever radial length is less than the inner radius of the inner ring—in other words, withdrawing or hiding the level. Articulating or unfolding the lever brings it or extends it to greater than the inner radius of the inner ring. The light diffusion dish is engaged with the top cover and positioned over the housing such that the central orifice may receive the post and be rotatably joined to the housing, via the mating of the first and second sets of threads. This removably seals the compartment with the light diffusion dish and the top cover. Rotation of the top cover and the light diffusion dish increases the degree of mating of the first and second sets of threads. The light source is thus configured such that increases the degree of mating of the first and second sets of threads and increases exposure of the cross sectional transmissive surface to the light source, thereby increasing light transmitted into the light diffusion dish.

Another embodiment of the lamp is directed to a table top that defines a cavity in its surface. The cavity or hole in the table top has a first effective diameter. The lamp comprises at least one housing with a bottom supporting frame and an outer wall, the outer wall and bottom supporting frame defining a compartment with a top opening. The compartment outer wall has an outer surface with a second effective diameter that is less than the first effective diameter. Substantially all of the housing may be placed within the cavity. A fastener may be used for fastening the housing to the table top when the housing is placed within the cavity. The housing further comprises an inner vertical surface that defines a first set of threads.

The low profile lamp includes at least one electric light source, an electric power supply, and wiring or circuitry in electrical communication with the electric power supply and the at least one light source to power the at least one light source. The circuitry may also comprise a switch for controlling said light source. The at least one electric light source, the electric power supply, the circuitry, and the switch may be positioned within the compartment of the housing.

The lamp may include a top cover having a crown and a post extending downwardly from the crown. This post may define a second set of threads that are adapted to mate with the first set of threads. The lamp may include a horizontally disposed light diffusion dish with a third effective diameter less than or equal to the first effective diameter. This light diffusion dish may define a central orifice for receiving said post, while exposing a cross sectional transmissive surface of the light diffusion dish to the central orifice. The light diffusion dish is adapted to be engaged with the top cover and positioned over the housing, while it is fastened to the table top within the cavity, such that the central orifice receives the post. The top cover and the light diffusion dish may be rotated relative to the housing in a desired direction. With this rotation the post may be rotatably joined to the housing via the mating of the first and second sets of threads, removably sealing the compartment with the light diffusion dish and the top cover. In addition, such rotation of the top cover and the light diffusion dish increases the degree of mating of the first and second sets of threads. The light source is configured such that increasing the degree of mating of the first and second sets of threads increases exposure of the cross sectional transmissive surface to the light source, increasing light transmitted into the light diffusion dish.

In some embodiments, the housing defines a central cylinder with an inner vertical surface defining the first set of threads such that when the first set of threads and second sets of threads are mating, the table top, housing, central cylinder, and post might define a centrally disposed open annulus oriented along a substantially vertical axis within the cavity. This annulus may have a fourth effective diameter that is less than the second effective diameter but sufficient to allow for insertion of a shaft of a fifth effective diameter that is less than the fourth effective diameter. Such a shaft could be support an umbrella, for example.

The light source is centrally disposed about the central cylinder and at a focal angle selected between an angle perpendicular to the vertical axis and an upward angle along the vertical axis.

In some embodiments, the light source may be an LED, an LED rope or string, a fluorescent strip light, an incandescent light ring, or a neon light.

In one optional embodiment, the switch may include a proximity sensor so that the light source may be activated at least once by rotation of the top cover and the light diffusion dish relative to the housing.

In some embodiments, the low profile table lamp may be configured such that a desired degree of mating of the first and second sets of threads positions at least a portion of the light diffusion dish and the top cover substantially coplanar with the top surface of the table top.

In some embodiments, the light source is centrally disposed about the central cylinder and at a focal angle selected between an angle perpendicular to the vertical axis and an upward angle along the vertical axis.

In some embodiments, the central cylinder and the post hollow allowing for a shaft to pass through and remain removably joined around the shaft.

In another embodiment the decorative low profile table lamp provides uniform circumferential illumination.

In another embodiment the light diffusion dish may be transparent, translucent, colored, either by paint or by tint or textured, etched, engraved or coated on the surfaces for desired diffusion of light or may have a combination of two or more attributes that may be in a desired decorative pattern.

In another embodiment the coating on the light diffusion dish may contain metallic pigments promoting light across the dish toward the edge of the dish.

In another embodiment a waterproof seal may be placed between the base housing and the light diffusion dish.

In another embodiment the light diffusion dish has a magnet adhered to or embedded within the bottom surface of the light diffusion dish.

In another embodiment the light source is centrally disposed about the central cylinder and focally perpendicular, or axially vertical in an upward direction or any angle therebetween in relation to the central cylinder axis.

In yet another embodiment the base housing may incorporate additional devices such as speakers.

In another embodiment the light diffusion dish is structurally capable of supporting objects that are normally found on a table top such as glasses, vases and decorative objects.

In another embodiment the decorative low profile table lamp may be embedded within a table top providing a continuous table surface.

In another embodiment the decorative low profile table lamp may be mounted to a table top by a fastener or adhesive where access to the battery, to facilitate replacement, is above the table top.

In another embodiment the light diffusion dish may be flat or convex and made of glass or plastic.

In yet another embodiment the light diffusion dish may have edges that are flat, beveled, chamfered, rounded or textured.

In another embodiment the decorative pattern may ergonomically aid in rotating the top cover crown or light diffusion dish.

In another embodiment the crown may be round, square or any desired shape.

In another embodiment the switch device may be a magnetic switch, micro switch, rotary switch or rheostat switch or may be controlled by a sensor and remote control device and means where partial rotation of the top cover may activate the switch or activate the switch more than once in a single rotation.

In another embodiment the base housing may be any suitable plastic, ceramic, rubber, fiberglass or phenolic.

In another embodiment the top cover is made of any suitable plastic, ceramic, rubber, fiberglass or phenolic.

In another embodiment the light may be an LED, an LED rope or string, an incandescent ring, or a neon light source.

In another embodiment rotational motion of the light diffusion dish and top cover provides the means to actuate the switch to turn the light on or off or in the case of a rheostat switch varying intensities of light.

In another embodiment the lamp may be fixedly mounted or adhered to a rotary turntable such as "lazy susan" device for placement on a table surface or within a table top cavity as a low profile rotational lamp.

In another embodiment the low profile rotational lamp that is adhered to the turntable device may have a lever for actuating a switch in an arcuate manner for turning the lamp on and off.

In another embodiment the low profile rotational lamp assembly that is adhered to the turntable device is a unitary device unless the top cover assembly is unthreaded from the base housing.

In another embodiment the low profile rotational table lamp for a table top has at least one housing having a bottom wall and an outer wall. The outer wall and bottom wall define a compartment with a top opening. The compartment has an inner depth less than the outer effective depth, if the housing is to be placed within a cavity or hole of a table top. Similarly, the outer wall has an outer surface with an inner effective diameter less than the outer effective diameter of such a cavity or hole. The housing further has an inner surface that defines a first set of threads. At least one electric light source is provided, with an electric power supply and circuitry in electrical communication with the electric power supply and the light source to power the light source. The circuitry further may employ a switch for controlling the light source. The at least one electric light source, electric power supply, circuitry, and switch device may be disposed or positioned within the compartment of the housing. Included is a top cover having a crown and a post that extends downwardly from the crown. The post defines a second set of threads adapted to mate with the first set of threads. A light diffusion dish with a third effective diameter greater than or equal to the first effective diameter defines a central orifice for receiving the post while exposing a cross sectional transmissive surface of the light diffusion dish to the central orifice. A ring assembly may be included, the assembly having an outer ring and an inner ring rotatably engaged and in bearing contact with the outer ring. The outer ring may have at least one pad for supporting the outer ring upon a table top and the inner ring has at least one mounting foot for supporting and adhesively attaching to the light diffusion dish at a desired height providing a gap above the inner ring. A lever attached to the bottom housing and extending radially so as to protrude between the inner ring top surface and the light diffusion dish bottom surface. The lever may have a hinge (with a vertical articulating axis) and positioned at a desired point on the lever within the inner radius of the inner ring so as to enable the lever to articulate about the vertical axis. The lever and hinge are configured so that when the lever is articulated the lever radial length is less than the inner radius of the inner ring. When the lever is not articulated, the lever is accessible between the inner ring top surface and the light diffusion dish bottom surface. The light diffusion dish is engaged with the top cover and positioned over the housing such that the central orifice receives the post and unitarily rotated relative to the housing in a desired direction so that the post may be rotatably joined to the housing mating the first and second sets of threads. This removably seals the compartment with the light diffusion dish and the top cover. Rotation of the top cover and the light diffusion dish increases the degree of mating of the first and second sets of threads such that the light source configuration increases the degree of mating of the first and second sets of threads and increases exposure of the cross sectional transmissive surface to the light source thereby increasing light transmitted into the light diffusion dish.

DETAILED DESCRIPTION

The following detailed description is an example of embodiments for carrying out the invention. This description is not to be taken in a limiting sense, but is made merely for the purpose of illustrating general principles of embodiments of the invention.

Disclosed is a low profile lamp for use with a table top. A primary embodiment is suitable for use with a table having a table top that defines a cavity with a first effective diameter and a first effective depth. As an overview, FIG. 6C shows an embodiment of the low profile lamp [1] when assembled and installed within a table top. FIGS. 7A-7D show various decorative patterns that may be achieved with the low profile lamp [1]. Embodiments of lamp [1] may also be used with table tops in which the cavity is a through-hole (i.e., with an infinite or much greater effective depth), by use of a housing 25 that acts as a support frame interposed across the hole. Alternatively, some embodiments of low profile lamp [1] may be used on a surface of a table top lacking a cavity (i.e., having a first effective depth of zero).

Figure 1:
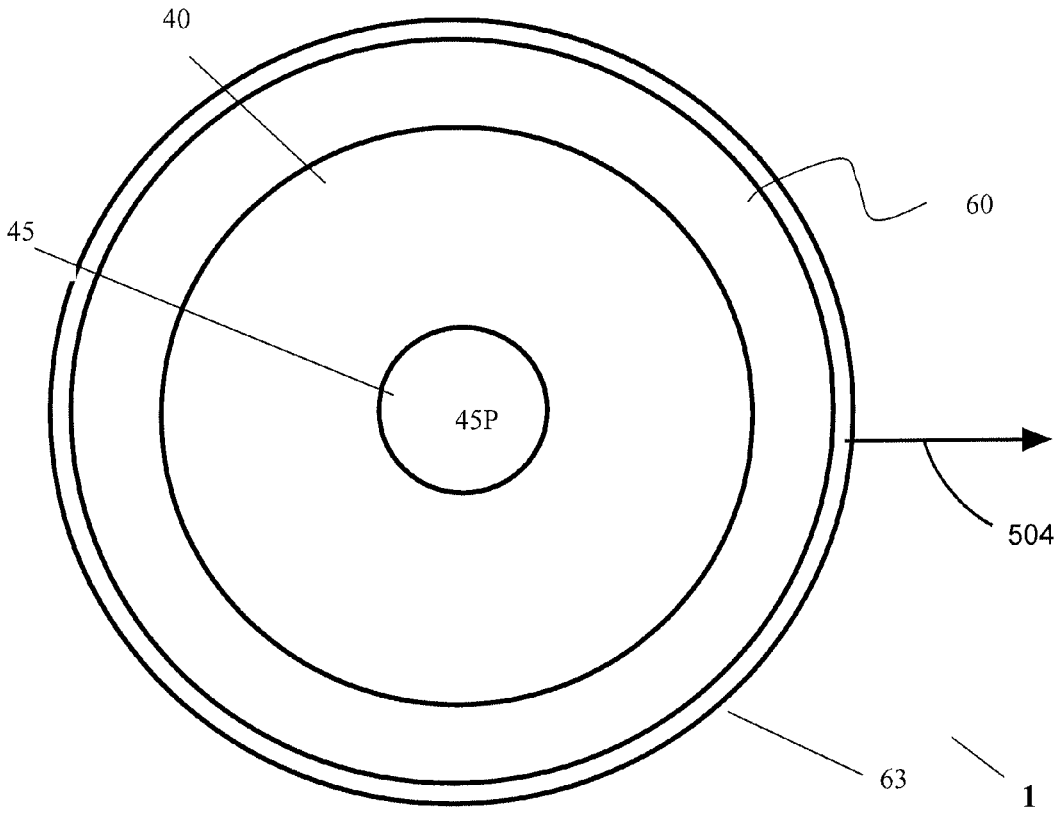
FIG. 1 is a top view of an embodiment of the low profile table lamp.

In detailing particular components, FIG. 1 is a top view illustration of a low profile table lamp [1] where light [504] may emit from an outer edge [63] of the light diffusion dish [60]. An optional decorative pattern or etching within in the light diffusion dish [60] top surface may also emit light. As illustrated, there is a top cover [40] with a post [45] optionally defining a hollow passage 45P with a cross section smaller than the lamp diameter. Passage 45P is a vertically oriented, centrally disposed open annulus that allows the lamp [1] to surround, host, or receive an optional or accessory shaft or pole that has a diameter smaller than that of the annulus, such as an umbrella pole (not shown) in a longitudinal direction along the post [45] and being centrally located on a table. The low profile lamp [1] need not be secured to the accessory shaft or device, such as an umbrella.

The lamp [1] may provide uniform or variable illumination, indirect or direct, and notably a form of peripheral illumination (e.g., light [504]). The primary embodiment of lamp [1] shown is a round version with a desired diameter; however the lamp [1] may be a variety of desired overall horizontal profile or shape and therefore the term "effective" as in effective diameter is meant to refer to a dimension in the context of claimed relative dimensions for the desired shape and embodiment.

The low profile lamp [1] shown is generally removably secured or fastened to a table top, and in some embodiments is recessed in a cavity defined within a table top; fastening may be by a variety of approaches, whether screw fasteners, gravity wedges, mating or tabbed structures, etc. The cavity may allow for rotational motion of the top cover [40], while holding the at least one housing [25] stationary, in order to use the relative rotation to activate and deactivate the lamp [1] and allowing for replacement of an internal battery [5] (not shown) or light source (not shown) by removing the top cover [40] (both as described in greater detail below, and shown in FIG. 2.) Battery [5] (see FIG. 2) replacement may be performed without removing the accessory shaft or umbrella pole, or removing the lamp [1] from the table top. Battery replacement is enabled from above the table top surface, which advantageous feature eliminates the inconvenient need to access batteries from beneath the table surface. An additional feature is that embodiments of the lamp [1] are structurally capable of supporting objects that are normally found on a table top such as tableware, glasses, vases, and decorative objects, and may be embedded (or give the appearance of being embedded) in the table top cavity in order to provide a continuously flat table top surface.

Figure 2:
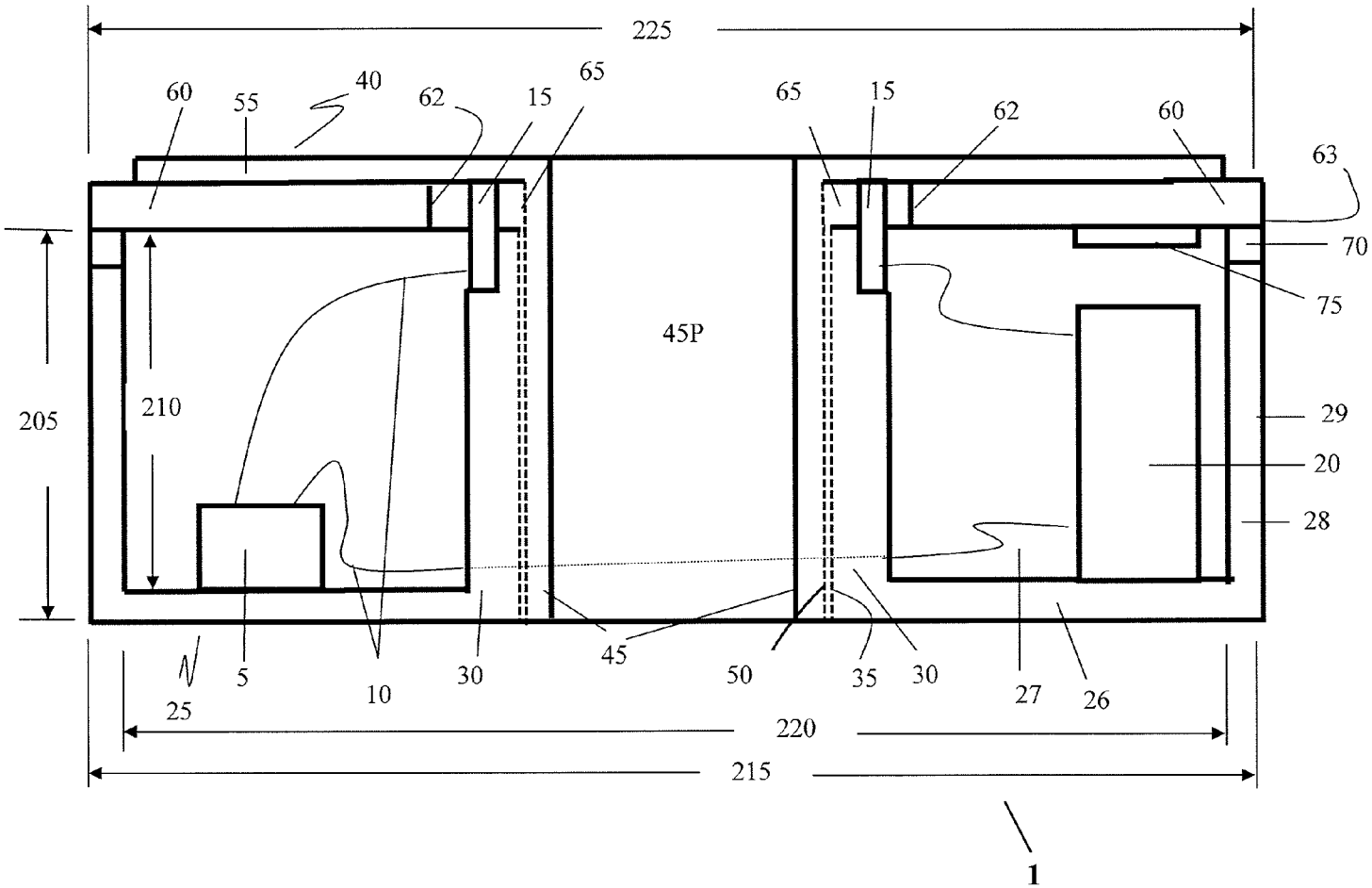
FIG. 2. is a cross section view of aspects of a decorative low profile table lamp.

FIG. 2 is a sectional side view of the lamp [1]. Internal to the lamp [1] may be an electric power supply or battery [5], circuitry [10] and at least one light source [15] that may be activated by switch [20]. The battery [5], circuitry [10], at least one light source [15], and switch [20] are in electrical communication with each other. Housing [25] acts as a base, and provides internal structure forming a centrally situated vertical surface or cylinder [30], shown located at or about an approximate center point of housing [25] and generally perpendicular to a horizontal axis of housing [25]. The central cylinder [30] or other inner vertical surface of housing [25] may have inclined ridges or a first set of threads [35] and is shown with a hollow passage. Housing [25] generally forms at least one compartment [27] that has a volume large enough to contain the above described battery [5], circuitry [10], light source [15] and switch [20] (i.e., housing [25] defining an internal compartment). The compartment [27] may have a horizontal supporting bottom [26] or other such supporting frame or bottom structure and an outer wall [28]. The outer wall [28] may have an outside (or second, in reference to the cavity) effective depth [205] and an inner effective depth [210] (indirectly defining the thickness of the housing [25] at the bottom [26]). The outer wall [28] also has a outer (or second, in reference to the cavity) effective diameter [215] (i.e., at outer surface [29]) that is larger than an inner effective diameter [220] (indirectly defining the thickness of the housing [25] at the outer wall [28]). The light source [15] may be a ring or rope of LEDs that is mounted generally in the housing [25], or centrally disposed around the central cylinder [30] generally closest to a top cover [40]. The focal point of the light source [15] may be horizontal or perpendicular to the vertical axis facing away from the central cylinder [30] or upward in a vertical angle facing the top cover [40] or any angle therebetween. Reflective surfaces may be added to a surface of the LED ring to better direct light to an internal dish edge [62] or cross sectional transmissive surface of the light diffusion dish [60] defined and exposed to a central orifice [65] in the light diffusion dish [60]. The inner surface or optional central cylinder [30] may have features that are used to locate or position the light source [15] at a desired distance from the top cover [40].

The top cover [40] has a centrally located vertical post [45] extending downwardly (that may also be hollow) with inclined ridges or defining a outer facing second set of threads [50] that mate with the first set of threads [35]. The post [45] also has a symmetrically located crown [55]. The crown [55] is defined as the component part of the top cover [40] that is visible from the post [45] to the outer circumference or perimeter of the top cover [40]. The crown [55] may vary in dimension based on the desired lamp [1] illumination pattern or effect. The light diffusion dish [60] contains the internal dish edge or cross sectional transmissive surface [62] of the diffusion dish [60] which defines or opens to the central orifice [65]. The light diffusion dish [60] also has an outer diameter defined by an outer edge [63] which is essentially a third effective diameter [225] that is less than or substantially equal to the first effective diameter of the table top cavity. The central orifice [65] diameter is shown larger than optional central cylinder [30] and light source [15], allowing post [45] to mate internally (optionally with the inner surface supported by central cylinder [30]). In this fashion, the illumination from the light source [15] is allowed to travel through the internal dish edge or cross sectional transmissive surface [62] (open to central orifice [65]) to be transmitted to and emitted through the outer edge [63] of the light diffusion dish [60]. The internal dish edge or cross sectional transmissive surface [62] has been found to transmit or disburse the illumination more evenly when the cross sectional transmissive surface [62] and/or outer edge [63] has a matte like finish. A clear cross sectional transmissive surface [62] and/or outer edge [63] will allow for more illumination to pass through, but may be uneven. The light diffusion dish [60] may be glass or plastic. The crown [55] has an outside dimension greater than the central orifice [65] and may be engaged with or adhered to the light diffusion dish [60] top surface. The top cover [40] and more particularly, the underside of the crown [55] may be coated with a reflective surface to reflect more light into the internal dish edge [62] of the central orifice [65]. A seal [70] may be included on or proximate the perimeter of housing [25] allowing for the top cover [40] to seal with the housing [25] when the second set of threads [50] are rotationally threaded into the first set of threads [35] to a desired distance, ultimately and preferably making the light diffusion dish [60] substantially coplanar with the top surface of the table top. The seal [70] may have a thinner upper edge to contact the light diffusion dish [60] to seal the lamp [1] yet allow sufficiently more compression to allow for variations in light intensity. In the situation where the switch [20] is a magnetic read switch, one or more magnets [75] may be adhered to the light diffusion dish [60]. A single magnet [75] or other proximity sensor may allow the light source [15] to turn on once during rotation of the light diffusion dish [60] where the intensity of the light source [15] is consistent and either on or off.

Rotation of the top cover [40] provides a means to seal the housing [25] and the top cover [40] from outside elements. Fully engaged, the top cover [40] is supported by the housing [25] (e.g., by top surface of the optional central cylinder [30]) and the seal [70] and edge of the housing [25]. The profile allowed when the top cover [40] and housing [25] are fully engaged is a substantially coplanar surface in regards to the table top. The same rotation allows for activating optional switch [20] thus turning on the light source [15]. The seal [70] allows actuation of the switch [20] even when the light diffusion dish [60] is not at its lowest position, or fully compressing the seal [70]. The switch [20] may be by contact (i.e., on/off) or by rheostat (i.e., variable) thus providing instant or gradual illumination, and further may be a micro switch or rotary switch. In some embodiments, variation in illumination intensity may be achieved by rotating the top cover [40] partially, creating a variation in the distance between the light source [15] and the central orifice [65], with the increasing degree of mating of the first and second threads [35, 50] increasing the exposure of the cross sectional transmissive surface [62] to the light source [15], thereby increasing the light transmitted into the light diffusion dish [60]. More than one magnet [75] or field may be employed to allow for illumination of the light source [15] while allowing for distance and focal variations in light source [15] to the cross sectional transmissive surface [62] and central orifice [65]. The variation in perceived illumination intensity is not derived solely electrically through variations in electrical resistance. The incline of the first set of threads [35] and second set of threads [50] rotatably define a linear vertical distance between the light source [15] and the central orifice [65] changing the focal distance and direction of the light source [15], and thus the exposure of the cross sectional transmissive surface [62] to the light source [15], thereby increasing the light transmitted into the light diffusion dish [60], varying the emitted illumination. Rotation in the opposite direction may deactivate the switch [20] turning off the light source [15]. Continuing rotation in this direction allows for removal of the top cover [40] and access to the battery [5] through the top of the lamp [1]. When the lamp [1] has a hollow post [45] and hollow central cylinder [30], a shaft of a diameter less than the internal diameter of the post [45] and cylinder [30] may be inserted through the central portion, such as an umbrella for an outside dining table. The design allows for removal of the top cover [40] for battery [5] access, without having to remove the umbrella shaft (not shown).

Figure 3:
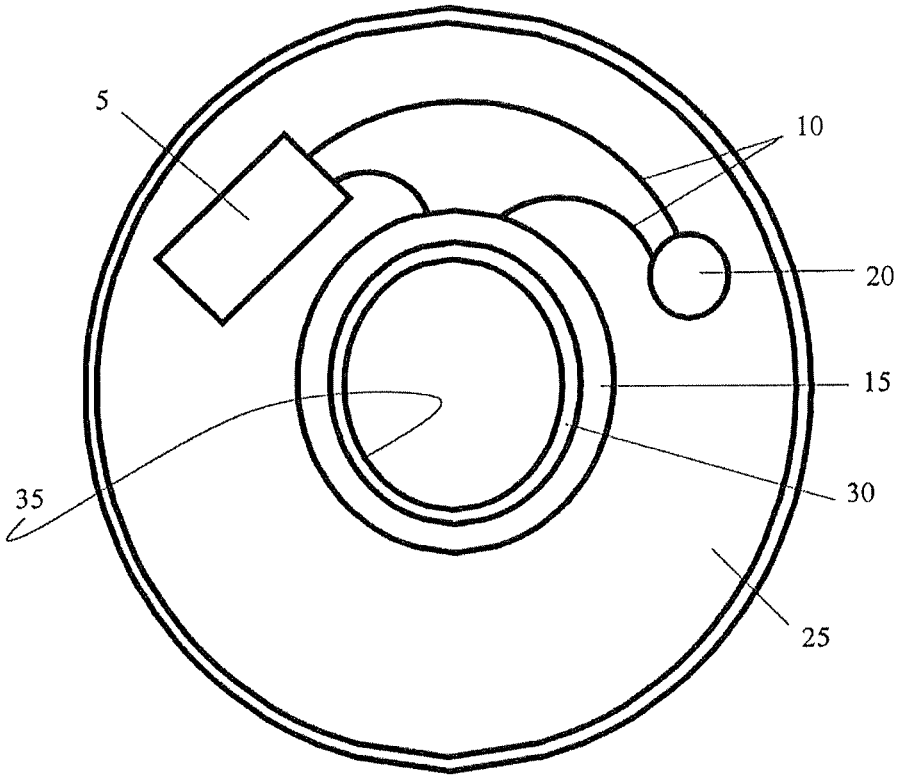
FIG. 3 shows a top view of the bottom housing.

Thus, the bottom [26] and outer wall [28] define compartment [27] which may be open to the top. In an alternative embodiment, low profile lamp [1] may be designed to be situated on top of a table top, or installed within a cavity defined by the table top. In embodiments with a cavity (i.e., having a first effective depth greater than zero), housing [25] has an outer or second effective depth [205] less than the first effective depth of the cavity (not shown) in order to fit within the cavity. The outer wall [28] has an outer surface [29] with a outer or second effective diameter [215] less than the first effective diameter of the cavity (not shown). Substantially all of the housing [25] may be placed within the cavity provided by the table top, as desired for a particular design. The housing [25] defines an inner surface or central cylinder [30] with a first set of threads [35]. The housing [25] is shown with a hollow annulus or passage allowing for the shaft of an umbrella or decorative item (not shown) that may be placed axially through, notionally in a substantially vertical direction or axis FIG. 3 shows another top view of housing [25]. Residing within the housing [25] are battery [5], circuitry [10], light source [15] (shown here for illustration as a ring of LED lights) and switch [20]. The light source [15] is shown located around the perimeter of the central cylinder [30]. The light source [15] may also include one or more ring of neon or fluorescent tape or incandescent bulb. The housing [25] may be plastic, ceramic, rubber, fiberglass, phenolic or coated or painted metals. The housing [25] may also incorporate additional devices such as speakers (not shown). The housing [25] may have holes, recesses, lips and features for locating components or for mounting to tables or other surfaces. In some embodiments, bottom [26] (not shown) may be in the form of horizontally supporting stringers, a support frame, or other structure, sufficient for its supporting function but not required to seal or form a complete barrier about compartment [27], etc.

Figure 4:
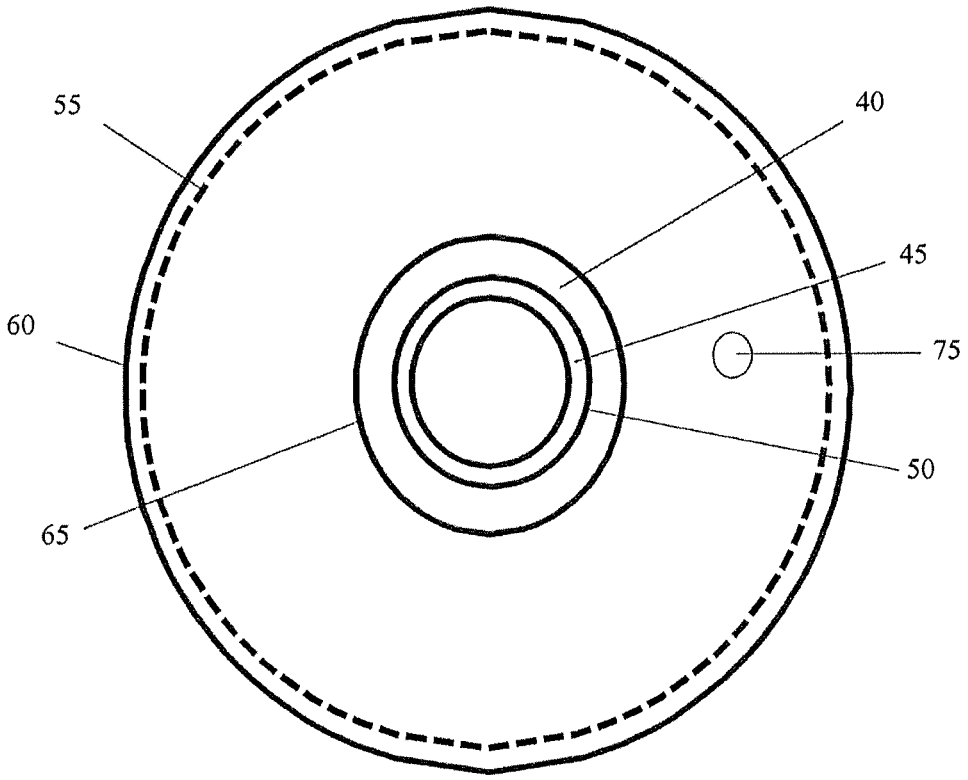
FIG. 4. shows a bottom view of the top cover.

FIG. 4 is a bottom view, showing top cover [40], post [45], second set of threads [50], light diffusion dish [60], central orifice [65] and optional magnet [75]. Shown as a hidden line is an embodiment of crown [55]. The central orifice [65] is shown with a larger diameter than the central cylinder [30], with light source [15] (not shown) allowing illumination to enter the cross sectional transmissive surface [62] (see, e.g., FIG. 2) along the internal dish edge of the central orifice [65] for transmission into the light diffusion dish [60]. To aid transmission of the illumination, the light diffusion dish [60] may be glass or plastic with any surface being at least transparent, translucent, colored, either by paint or tint, textured, etched, engraved or coated on the surfaces for the desired diffusion of emitted light. The light diffusion dish [60] may contain a combination of two or more treatments for decorative or aesthetic purposes or for ergonomic ease in removal or securing the top cover [40] to the housing [25]. Coatings may include metallic pigments to promote the transmission of light across the light diffusion dish [60] for emission of light along the outer edge [63] perimeter. The outer edge [63] of the light diffusion dish [60] may be flat or convex, with the outer edges [63] perpendicular to the top and bottom planar surfaces, beveled, chamfered, rounded, textured, matte or translucent.

The top cover [40] may be made of plastic, ceramic, rubber or any suitable material with a crown [55] perimeter that is larger than the central orifice [65]. The crown [55] is adhered to the light diffusion dish [60] such that the light diffusion dish [60] and the top cover [40] rotate as a single component when the second set of threads [50] of the post [45] are actively engaged with the first set of threads [35] of the central cylinder [30]. The top cover [40] may also incorporate decorative designs or with features to aid in rotational movement by a user. The crown [55] may also be of any desired shape and conform to the shape of the light diffusion dish [60] with a convex or flat top crown [55] surface. The light diffusion dish [60] could have a concentric recess allowing for the top surface of the crown [55] to reside in a planar fashion with the top of the light diffusion dish [60].

Figure 5:
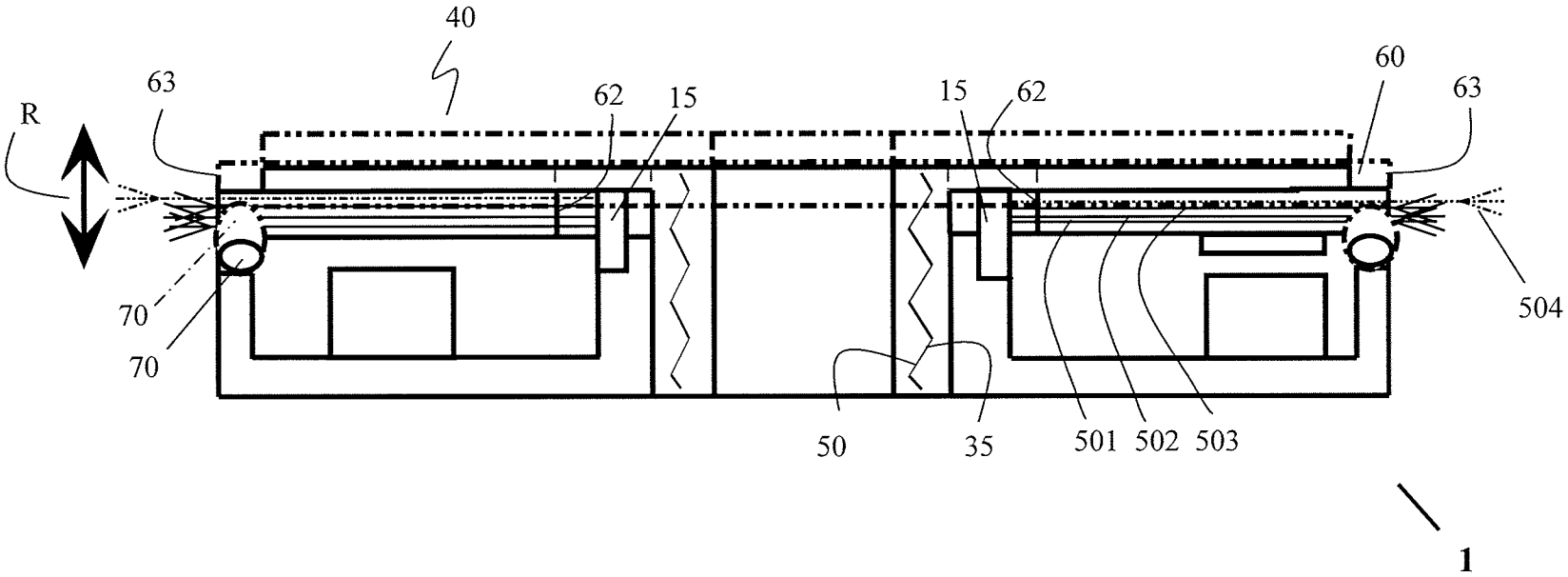
FIG. 5 shows how the variation in height of the top cover changes the perceived illumination intensity of an embodiment of a lamp.

FIG. 5 is a cross sectional illustration that shows the relationship of the components of the lamp [1] when the lamp [1] is not fully closed versus being fully closed (i.e., with relative motion R). In particular, the illumination from the light source [15] is illustrated by light beams (sequentially from the bottom of the figure to the top of the figure) [501, 502, 503, 504]. When the lamp [1] is fully closed, light beams [501, 502, 503, 504] are transmitted through the internal dish edge [62] through the light diffusion dish [60] and emitted through the outer edge [63]. When the top cover [40] and light diffusion dish [60] are rotated along the first set of threads [35] and second set of threads [50], the top cover [40] and light diffusion dish [60] are moved linearly away from the housing [25]. Since the light source [15] is integral to the base housing [25] the linear relationship of the top cover [40] and light diffusion dish [60] to the light source [15] is also affected. In FIG. 5, the phantom lines depict the linear movement of the top cover [40] and light diffusion dish [60]. As the top cover [40] and light diffusion dish [60] move away from the light source [15]

in a vertically upward motion, fewer light beams (shown as only 504) are allowed to pass into and through the internal dish edge [62]. Light beams [501, 502, 503] remain under the light diffusion dish [60] and invisible to the user. Therefore the light source [15] provides consistent light beam [501, 502, 503, 504] output, however light beam [504] is the only one emitting from the outer edge [63]. In this instance, the user then perceives a dimming of the illumination intensity. The variation in illumination (dimming or intensity) is controlled by mechanical rotational and linear motion rather than electrical means. FIG. 5 also shows the flexibility of the seal [70] that allows for sealing the lamp [1] when the top cover [40] and light diffusion dish [60] are not fully seated on the housing [25].

Figure 6A:
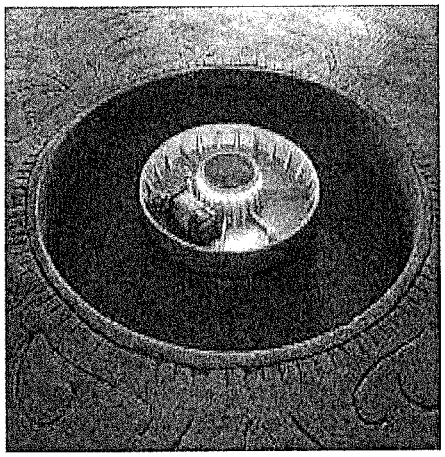
FIG. 6A shows the exposed housing inserted in a table top.
Figure 6B:
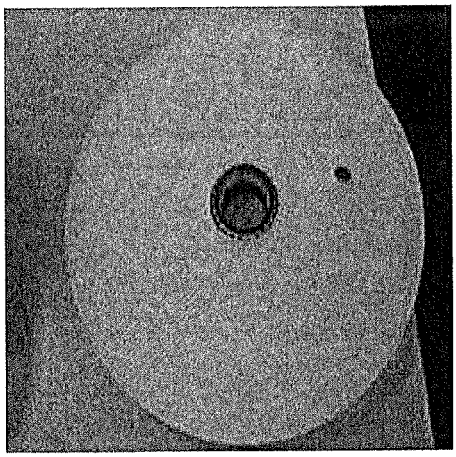
FIG. 6B shows the assembled top cover.
Figure 6C:
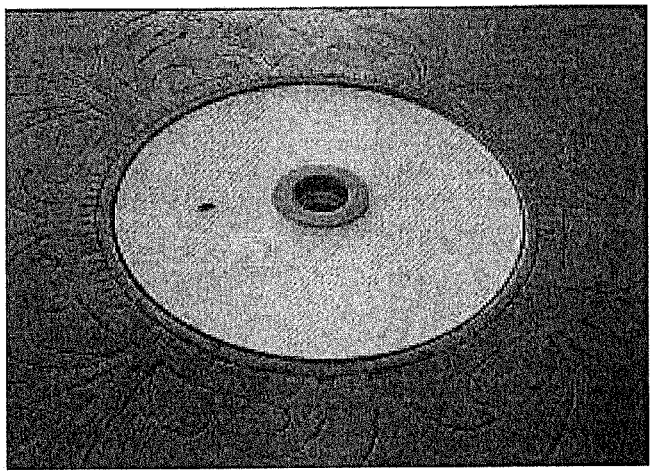
FIG. 6C shows the assembled lamp in a table top.
Figure 7A:
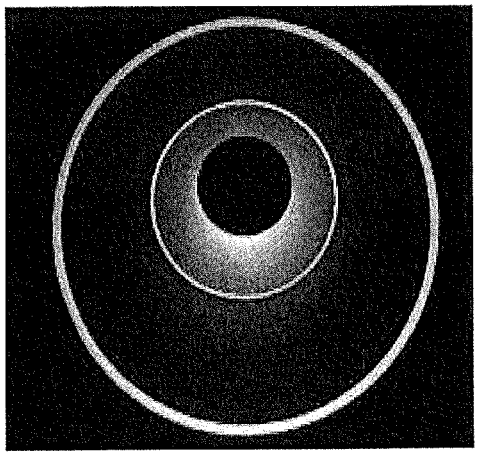
FIGS. 7A-7D show various decorative patterns that may be achieved using the light diffusion dish of the present table lamp.
Figure 7B:
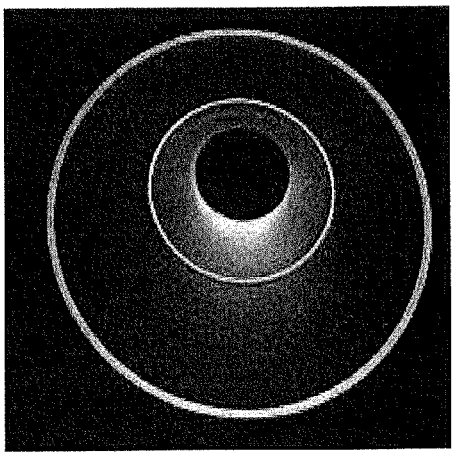
Figure 7C:
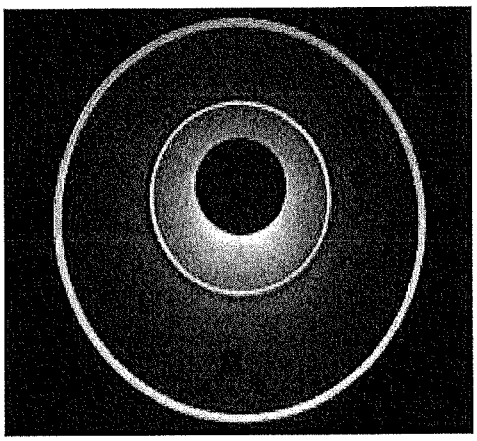
Figure 7D:
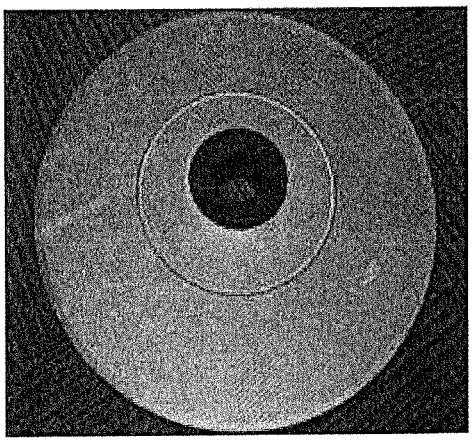

Housing [25] is shown exposed in FIG. 6A while fastened to the table top and within the table top cavity. FIG. 6B shows the top cover [40] as assembled. FIG. 6C shows the completed low profile lamp [1] within the table top cavity where the light diffusion dish [60] has a smaller third effective diameter [225] than the first effective diameter of the table top cavity allowing emitted light to be visible along the outer circumference of the light diffusion dish [60].

As noted above, FIGS. 7A-7D show various decorative patterns that may be achieved with the low profile lamp [1].

Figure 8:
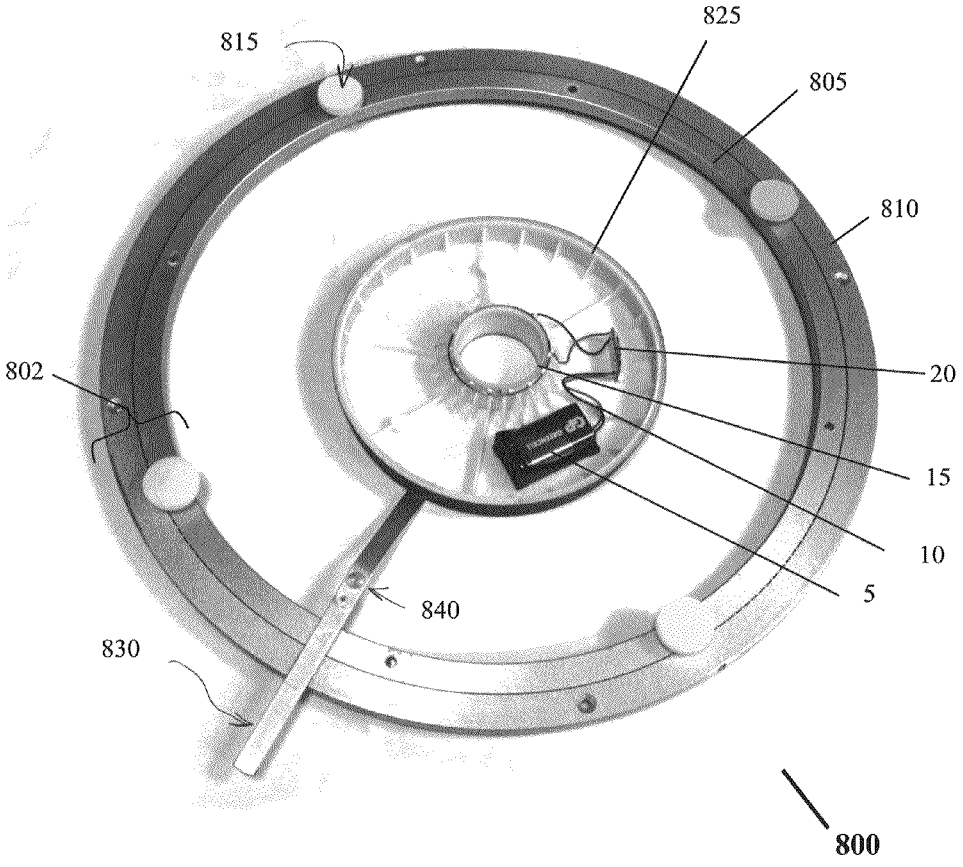
FIG. 8 shows a top view of a bottom housing placed centrally within a rotatable circular bearing ring.
Figure 9:
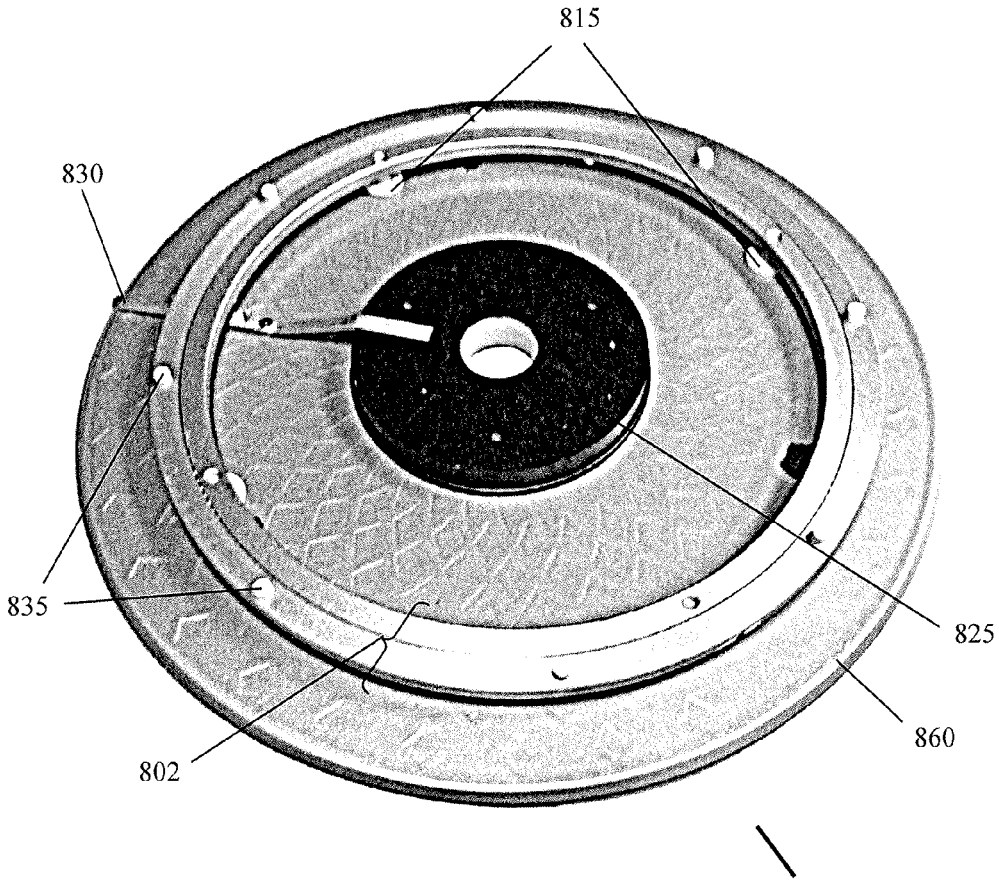
FIG. 9 shows a bottom view of the embodiment depicted in FIG. 8 assembled and including a light diffusion dish.

FIG. 8 shows a top view of an embodiment referred to as low profile rotational lamp [800]. Low profile rotational lamp [800] is illustrated with housing [825] placed centrally within a circular bearing ring [802], which enables relative rotation. Housing [825] does not fasten to a surface, and instead rotates within the surrounding circular bearing ring [802]. Shown for clarity are the battery [5], circuitry [10], light source [15], and switch [20]. Circular bearing ring [802] enables operation as a sort of "lazy susan," with rotation of the entire low profile rotational lamp [800] using bearing ring 802. Circular inner ring [805] may be in low friction contact (usually by bearings) with the circular outer ring [810]. Lever [830] may be attached to the outer surface of the housing [825]. Lever [830] may be angled or bent linearly so as to pass from the housing [825] inclined vertically to a desired height, such that the lever [830] fits through a near planar gap between the mounting feet [815]. Lever [830] height may thus be above or greater than the height of circular bearing ring [802], but less than the height of the mounting feet [815]. Lever [830] may protrude outside the circumference of the outer ring [810] a desired distance (also shown in FIG. 11). Lever [830] may have an articulating joint or hinge [840], which would allow for the lever [830] to be folded between the mounting feet [815]. Hinge [840] may be located on lever [830] for a folded radial length from centrally located housing [825] less than the inner circumference of the inner ring [805], as shown also in FIG. 10. In the examples of FIGS. 8 and 9, the mounting feet [815] are shown attached to the inner ring [805]. Also shown in FIG. 9 are pads [835], which may provide resilient contact surfaces for the outer ring [810] to contact a table top surface and provide non-skid surfaces so the bearing ring [802] does not move in a linear direction while the low profile table lamp [800] is being rotated. The pads [835] also provide stability should the low profile table lamp [800] be placed within a table top cavity with a solid surface. For this embodiment, no additional support would be needed for the bearing ring [802]. Should the low profile table lamp [800] be placed within a table top cavity, the entire low profile table lamp [800] assembly could be lifted as a unit to enable replacement of the battery [5]. In some embodiments, the mounting feet [815] may be attached to the outer ring [810] and the pads [835] may be attached to the inner ring [805].

Figure 10:
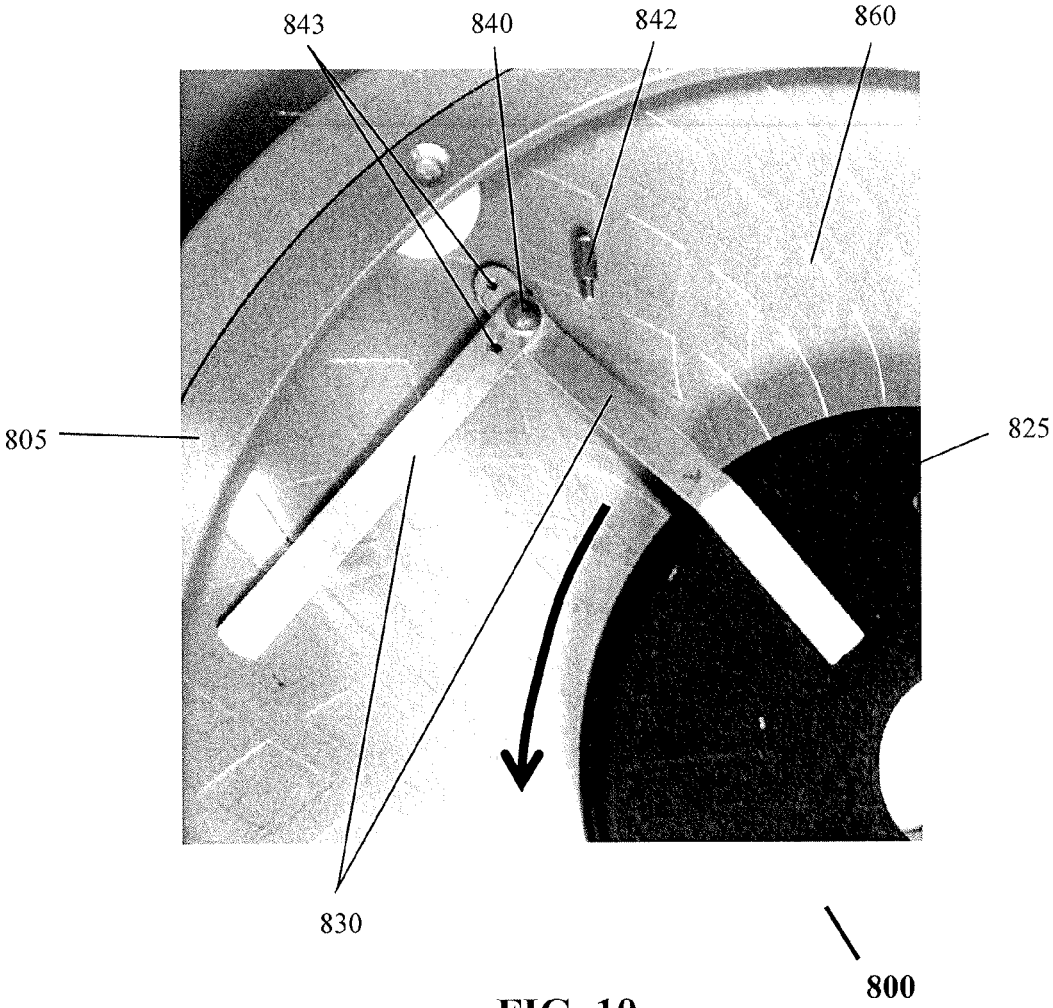
FIG. 10 shows the lever, bearing ring and rotation of the housing in relation to the light diffusion dish.

FIG. 9 is a bottom view of FIG. 8 assembled as low profile rotational lamp [800] with light diffusion dish [860]. The light diffusion dish [860] is centrally located on the circular bearing ring [802] and fastened or adhered to the mounting feet [815]. In this manner the light diffusion dish [860] and circular bearing ring [802] operate as an assembly providing rotational motion to the lamp [800]. As described earlier in reference to FIG. 2, the top cover [40] and housing [25] attach by means of a first set of threads [35] and second set of threads [50]. The top cover [850] (shown in FIG. 11), with light diffusion dish [860] and housing [825] (not shown) attach in a similar manner. As may be seen in FIG. 9, there may be separation of the housing [825] and light diffusion dish [860]. The perspective of FIG. 9 is a bottom view with lamp [800] turned upside down, revealing lever [830]. As shown in FIG. 10, lever [830] may be folded at the hinge [840] so the folded length of the lever is within the inner circumference of the inner ring [805]. The light diffusion dish [860] and attached inner bearing ring [805] are held rotationally stationary while the housing [825] may be rotated in a manner such that the first set of threads [35] (not shown) and second set of threads [50] (not shown) are unthreaded to allow separation of the housing [825] from the light diffusion dish [860]. The housing [825] and lever [830] may then be removed and inverted to expose the inner components and battery [5] for replacement.

Note that in FIGS. 8 and 9, lever [830] is shown between the mounting feet [815] and protruding past the outer circumference of the light diffusion dish [860]. In this configuration, movement of the lever [830] is limited to the arc length between the mounting feet [815]; however, for this configuration such an arc length could be sufficient movement of the lever [830] to activate or deactivate the switch [20] (not shown) within the housing [825].

FIG. 10 is also a bottom view of lamp [800], and shows in greater detail the articulation of the lever [830] around the hinge [840]. Shown are the lever [830], hinge [840], pin [842] and alignment holes [843]. In this depiction the pin [842] has been removed from securing the alignment holes [843]. Hinge [840] may be positioned on lever [830] to that lever [830] may be articulated to a length less than the diameter of the inner ring [805]. The housing [825] may then be rotated (as shown by the arrow) in relation to the light diffusion dish [860] until the housing [825] and light diffusion dish [860] are separated.

Figure 11:
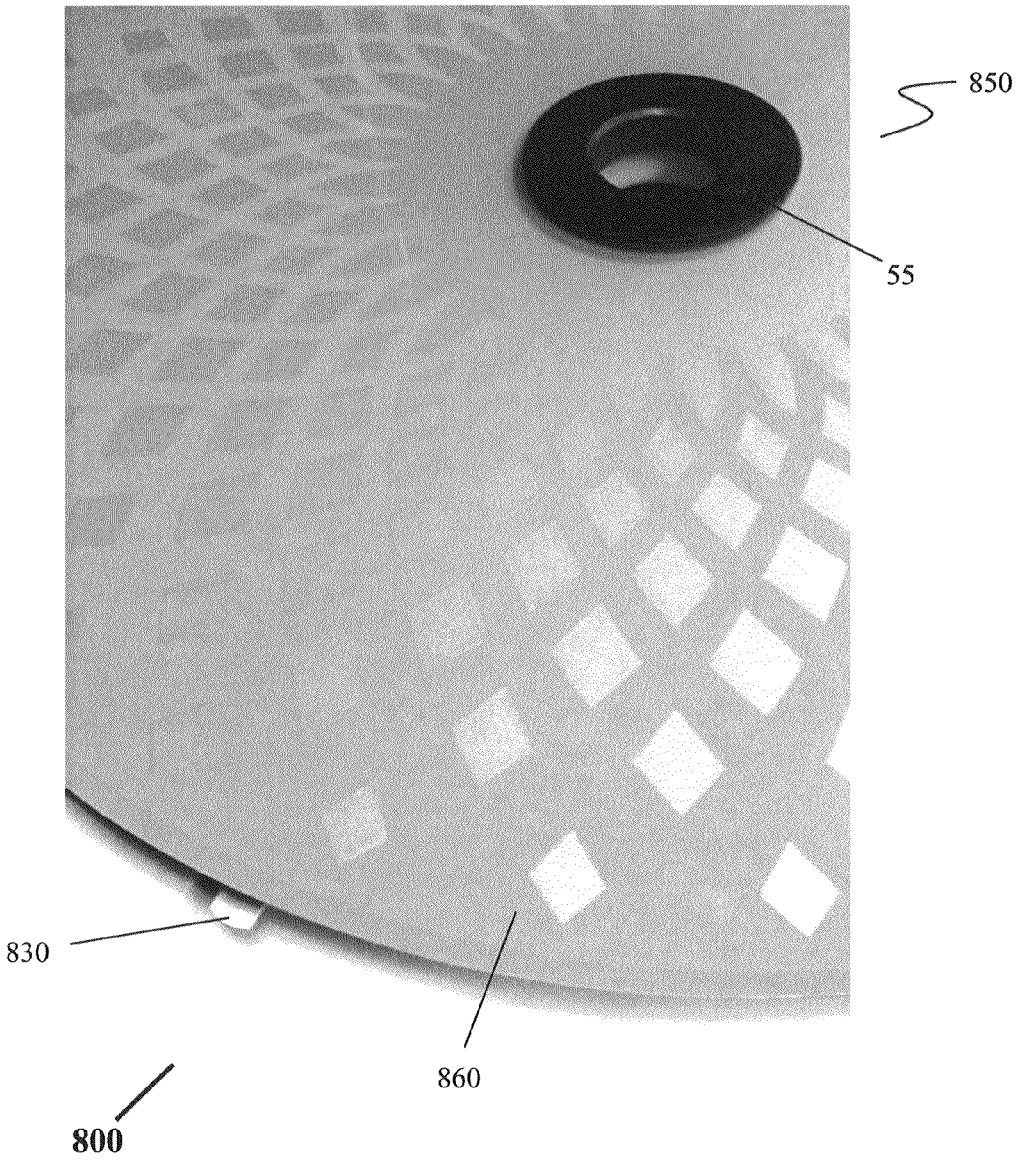
FIG. 11 shows the top of the light diffusion dish and crown of the rotatable lamp that make up the top cover.

FIG. 11 shows the top of the light diffusion dish [860] and crown [55] that make up the top cover [850]. Lever [830] may protrude past the circumference of the light diffusion dish [860] for convenient access to turn lamp [800] on or off.

Figure 12A:
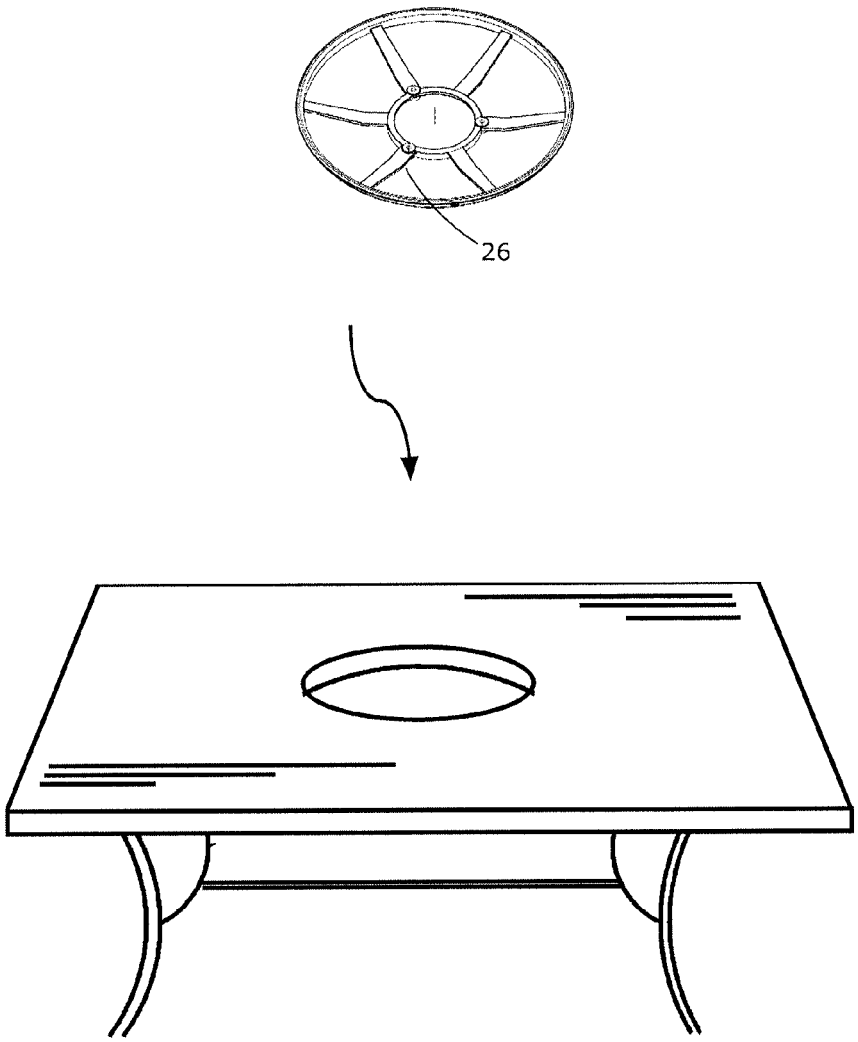
FIG. 12A-C show aspects of another embodiment of the low profile lamp.
Figure 12B:
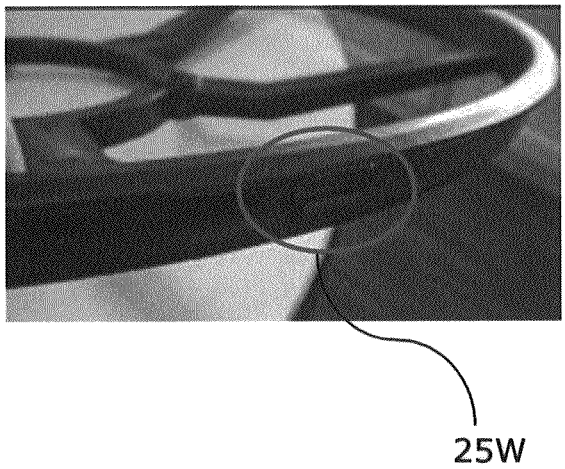
Figure 12C:
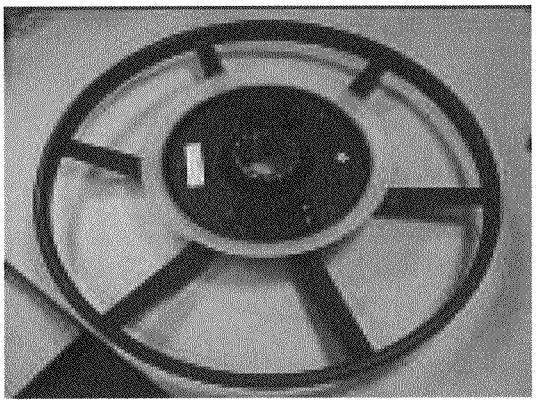

The above embodiments of lamp [1] described in detail have been for use with tables having a cavity with a first effective depth roughly on the same order as (but typically greater than) the second effective depth of lamp [1]. The first effective depth means that lamp [1] may rest within the cavity, as may be desired and as shown in FIG. 6C. However, some tables may have through-holes, or cavities that qualify also as a hole completely through the tabletop (i.e., also characterized as a cavity having an infinite or much larger effective depth). In such cases, lamp [1] may further comprise a bottom [26] in the form of a support frame, which may be inserted into the hole or cavity, and fastened to or wedged into the table, so as to be interposed across the hole and to create or provide support for lamp [1], as illustrated in FIG. 12A. Note that this embodiment does not (on its own) completely seal housing [25]. Such a support frame may include other portions of housing [25] or other structure of lamp [1], as shown in the highlight of FIG. 12B illustrating wedge [25W] as part of a fastener or fastening system. FIG. 12C is a top view of some aspects of such an embodiment. This approach introduces an additional feature of simplifying the manufacturing of components, including any table, reducing material consumption, and in some cases permitting retrofitting.

These contemplated arrangements may be achieved in a variety of configurations. While there has been described what are believed to be the preferred embodiment of the present invention, those skilled in the art will recognize that other and further changes and modifications may be made thereto without departing from the spirit of the invention, and it is intended to claim all such changes and modifications as fall within the true scope of the invention.

What is claimed is:

1. A low profile lamp for use within a table top having a top surface, wherein the table top defines a cavity with a first effective diameter and a first effective depth, the lamp comprising;

at least one housing comprising a bottom and an outer wall, the outer wall and bottom defining a compartment with a top opening, the compartment having a second effective depth less than the first effective depth, the outer wall having an outer surface with a second effective diameter less than the first effective diameter such that substantially all of the housing may be placed within the cavity, and wherein the housing further comprises an inner vertical surface that defines a first set of threads;

a fastener for fastening the housing to the table top when the housing is placed within the cavity;

at least one electric light source;

an electric power supply and circuitry in electrical communication with the electric power supply and the at least one light source to power the at least one light source;

wherein the circuitry further comprises a switch for controlling said light source, and wherein the at least one electric light source, the electric power supply, the circuitry, and the switch are positioned within the compartment of the housing;

a top cover comprising a crown and a post extending downwardly from the crown, said post defining a second set of threads adapted to mate with the first set of threads;

a horizontally disposed light diffusion dish with a third effective diameter less than or equal to the first effective diameter, and defining a central orifice for receiving said post while exposing a cross sectional transmissive surface of the light diffusion dish to the central orifice;

wherein the light diffusion dish is adapted to be engaged with the top cover and positioned over the housing while fastened to the table top within the cavity, such that the central orifice receives the post;

wherein the top cover and the light diffusion dish may be rotated relative to the housing in a desired direction so that the post may be rotatably joined to the housing via the mating of the first and second sets of threads, removably sealing the compartment with the light diffusion dish and the top cover; and wherein such rotation of the top cover and the light diffusion dish increases the degree of mating of the first and second sets of threads, and the light source is configured such that increasing the degree of mating of the first and second sets of threads increases exposure of the cross sectional transmissive surface to the light source, increasing light transmitted into the light diffusion dish.

2. The low profile table lamp of claim 1, wherein a desired degree of mating of the first and second sets of threads positions at least a portion of the light diffusion dish and the top cover substantially coplanar with the top surface of the table top.

3. The low profile table lamp of claim 1, wherein the housing further defines a central cylinder with an inner vertical surface defining the first set of threads, and when the first set of threads and second sets of threads are mating, the table top, housing, central cylinder, and post define a centrally disposed open annulus oriented along a substantially vertical axis within the cavity, the annulus having a fourth effective diameter that is less than the second effective diameter but sufficient to allow for insertion of a shaft of a fifth effective diameter that is less than the fourth effective diameter.

4. The low profile table lamp of claim 3, wherein the light source is centrally disposed about the central cylinder and at a focal angle selected between an angle perpendicular to the vertical axis and an upward angle along the vertical axis.

5. The low profile table lamp of claim 1, wherein the light source is an LED, an LED rope or string, a fluorescent strip light, an incandescent light ring, or a neon light.

6. The low profile table lamp of claim 1, wherein the switch includes a proximity sensor such that the light source is activated at least once by rotation of the top cover and the light diffusion dish relative to the housing.

7. A low profile rotational table lamp for a table top, the lamp comprising;

at least one housing comprising a bottom and an outer wall, the outer wall and bottom defining a compartment with a top opening, and wherein the housing further comprises an inner surface that defines a first set of threads;

at least one electric light source;

an electric power supply and circuitry in electrical communication with the electric power supply and the at least one light source to power the at least one light source;

wherein the circuitry further comprises a switch for controlling said light source, and wherein the at least one electric light source, the electric power supply, the circuitry, and the switch are positioned within the compartment of the housing;

a top cover comprising a crown and a post extending downwardly from the crown, said post defining a second set of threads adapted to mate with the first set of threads;

a horizontally disposed light diffusion dish defining a central orifice for receiving said post while exposing a cross sectional transmissive surface of the light diffusion dish to the central orifice;

a ring assembly comprising an outer ring and an inner ring rotatably engaged with and in bearing contact with the outer ring;

wherein the outer ring comprises at least one pad for supporting the outer ring upon a table top and the inner ring comprises at least one mounting foot for supporting and adhesively attaching to the light diffusion dish at a desired height, thereby providing a gap above the inner ring;

a lever attached to the bottom housing and extending radially so as to protrude between a top surface of the inner ring and a bottom surface of the light diffusion dish, the lever having a hinge with a vertical axis, the hinge positioned at a desired point on the lever within an inner radius of the inner ring so as to enable the lever to articulate about the vertical axis, the lever and hinge configured so that when the lever may be articulated to a lever radial length less than the inner radius of the inner ring or greater than the inner radius of the inner ring;

wherein the light diffusion dish is adapted to be engaged with the top cover and positioned over the housing such that the central orifice receives the post;

wherein the top cover and the light diffusion dish may be rotated relative to the housing in a desired direction so that the post may be rotatably joined to the housing mating the first and second sets of threads, removably sealing the compartment with the light diffusion dish and the top cover; and wherein such rotation of the top cover and the light diffusion dish increases the degree of mating of the first and second sets of threads, and the light source is configured such that increasing the degree of mating of the first and second sets of threads increases exposure of the cross sectional transmissive surface to the light source, increasing light transmitted into the light diffusion dish.

8. The low profile rotational table lamp of claim 7, wherein a desired degree of mating of the first second sets of threads positions at least a portion of the light diffusion dish and the top cover substantially coplanar with the top surface of the table top.

9. The low profile rotational table lamp of claim 7, wherein the housing further defines a central cylinder with an inner vertical surface defining the first set of threads, and when the first set of threads and second sets of threads are mating, the table top, housing, central cylinder, and post define a centrally disposed open annulus oriented along a substantially vertical axis within the cavity, the annulus having a fourth effective diameter that is less than the second effective diameter but sufficient to allow for insertion of a shaft of a fifth effective diameter that is less than the fourth effective diameter.

10. The low profile rotational table lamp of claim 9, wherein the light source is centrally disposed about the central cylinder and at a focal angle selected between an angle perpendicular to the vertical axis and an upward angle along the vertical axis.

11. The low profile rotational table lamp of claim 7, wherein the light source is an LED, an LED rope or string, a fluorescent strip light, an incandescent light ring, or a neon light.

12. The low profile rotational table lamp of claim 7, wherein the switch includes a sensor such that the light source is activated at least once by rotation of the top cover and the light diffusion dish relative to the housing.

13. A low profile lamp for use within a table top having a top surface, wherein the table top defines a cavity with a first effective diameter, the cavity comprising a hole in the table top, the lamp comprising;

at least one housing comprising a bottom supporting frame and an outer wall, the outer wall and bottom supporting frame defining a compartment with a top opening, the compartment outer wall having an outer surface with a second effective diameter less than the first effective diameter such that substantially all of the housing may be placed within the cavity, and wherein the housing further comprises an inner vertical surface that defines a first set of threads;

a fastener for fastening the housing to the table top when the housing is placed within the cavity;

at least one electric light source;

an electric power supply and circuitry in electrical communication with the electric power supply and the at least one light source to power the at least one light source;

wherein the circuitry further comprises a switch for controlling said light source, and wherein the at least one electric light source, the electric power supply, the circuitry, and the switch are positioned within the compartment of the housing;

a top cover comprising a crown and a post extending downwardly from the crown, said post defining a second set of threads adapted to mate with the first set of threads;

a horizontally disposed light diffusion dish with a third effective diameter less than or equal to the first effective diameter, and defining a central orifice for receiving said post while exposing a cross sectional transmissive surface of the light diffusion dish to the central orifice;

wherein the light diffusion dish is adapted to be engaged with the top cover and positioned over the housing while fastened to the table top within the cavity, such that the central orifice receives the post;

wherein the top cover and the light diffusion dish may be rotated relative to the housing in a desired direction so that the post may be rotatably joined to the housing via the mating of the first and second sets of threads, removably sealing the compartment with the light diffusion dish and the top cover; and wherein such rotation of the top cover and the light diffusion dish increases the degree of mating of the first and second sets of threads, and the light source is configured such that increasing the degree of mating of the first and second sets of threads increases exposure of the cross sectional transmissive surface to the light source, increasing light transmitted into the light diffusion dish.

14. The low profile table lamp of claim 13, wherein a desired degree of mating of the first and second sets of threads positions at least a portion of the light diffusion dish and the top cover substantially coplanar with the top surface of the table top.

15. The low profile table lamp of claim 13, wherein the housing further defines a central cylinder with an inner vertical surface defining the first set of threads, and when the first set of threads and second sets of threads are mating, the table top, housing, central cylinder, and post define a centrally disposed open annulus oriented along a substantially vertical axis within the cavity, the annulus having a fourth effective diameter that is less than the second effective diameter but sufficient to allow for insertion of a shaft of a fifth effective diameter that is less than the fourth effective diameter.

16. The low profile table lamp of claim 13, wherein the light source is centrally disposed about the central cylinder and at a focal angle selected between an angle perpendicular to the vertical axis and an upward angle along the vertical axis.

17. The low profile table lamp of claim 13, wherein the light source is an LED, an LED rope or string, a fluorescent strip light, an incandescent light ring, or a neon light.

18. The low profile table lamp of claim 13, wherein the switch includes a proximity sensor such that the light source is activated at least once by rotation of the top cover and the light diffusion dish relative to the housing.

* * * * *